United States Patent [19]

Johansson

[11] 3,933,451

[45] Jan. 20, 1976

[54] DUST COLLECTING BAG

[76] Inventor: Goran R. Johansson, Lilla Edet, Gota, Sweden

[22] Filed: Apr. 19, 1973

[21] Appl. No.: 352,709

[30] Foreign Application Priority Data

Apr. 24, 1972 Sweden ..... 5339/72

[52] U.S. Cl. ..... 55/367; 55/376; 55/DIG. 2; 55/DIG. 26; 229/62.5

[51] Int. Cl.[2] ..... B01D 46/02

[58] Field of Search ..... 55/367, 369, 371, 376, 55/377, DIG. 2, DIG. 26; 229/62.5; 137/525, 525.1, 525.3

[56] References Cited

UNITED STATES PATENTS

| | | | |
|---|---|---|---|
| 2,804,167 | 8/1957 | Seck | 55/367 |
| 3,401,867 | 9/1968 | Long et al. | 55/367 U X |
| 3,416,721 | 12/1968 | Fesco | 55/367 X |
| 3,423,907 | 1/1969 | Hughes | 55/367 |
| 3,432,998 | 3/1969 | Downey | 55/367 |

*Primary Examiner*—Frank W. Lutter
*Assistant Examiner*—Kathleen J. Prunner

[57] ABSTRACT

A dust collecting bag with a central opening in the endwall thereof, which opening can be covered and uncovered by a cover flap hinged on the endwall of which it constitutes an integral part so that a portion of its free edge opposite the hinged mounting is positioned within the area of the opening. The central opening has at least one locking flap disposed along a portion of the edge opposite the hinged mounting of the cover flap and the portion of the free edge of the cover flap within the area of the opening has slits extending from the edge, with the portion of the cover flap defined by the slits being pivotable out of the plane defined by the remainder of the cover flap. The locking flap bridges the space between the cover flap and the edge of the opening.

1 Claim, 8 Drawing Figures

DUST COLLECTING BAG

The present invention relates to a dust collecting bag, the end side of which is constituted by an endwall of comparatively rigid material, by way of example paper board.

It is a principal object of the invention to provide a dust collecting bag of the kind mentioned, which is comparatively cheap and which after its use can be closed in an efficient manner.

This object has been reached by a dust collecting bag made in accordance with the invention, characterized by a central opening in the endwall, which can be covered and uncovered respectively by pivoting of a cover flap hinged on said endwall. The cover flap may constitute an integrated part along a portion of the edge of said opening. The flap is shaped in such a way that when it covers the opening at least a part of its free defining edge is positioned within the area of the opening. At least one locking flap is provided, which bridges the interspace between the cover flap and the edge of the opening. The locking flap or flaps are pliant against the bias of a spring action and are passed in connection with the pivoting of the cover flap to the closing position and thereafter keep the cover flap in the closed position by lying tight against the outside of said cover flap.

Figure 3:
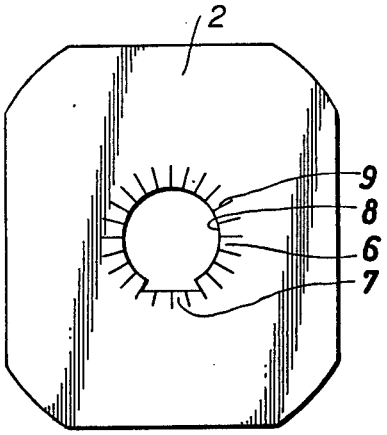
Figure 4:
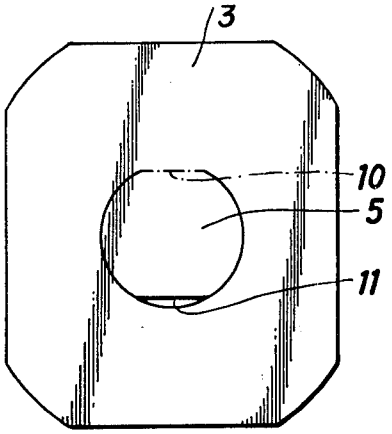
Figure 1:
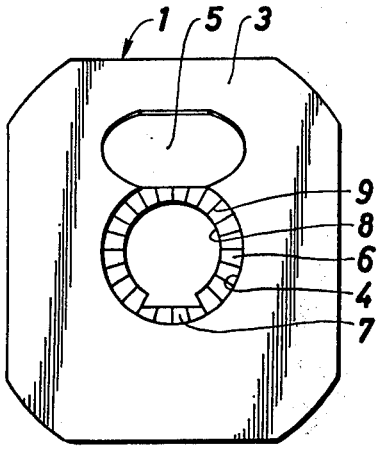
Figure 2:
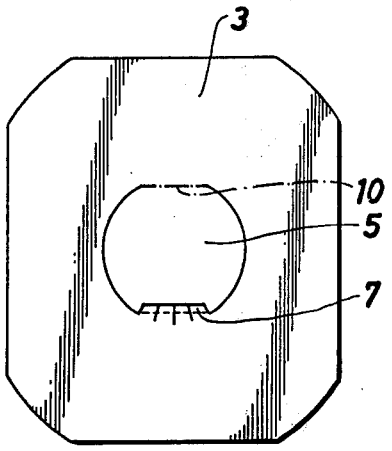
Figure 5:
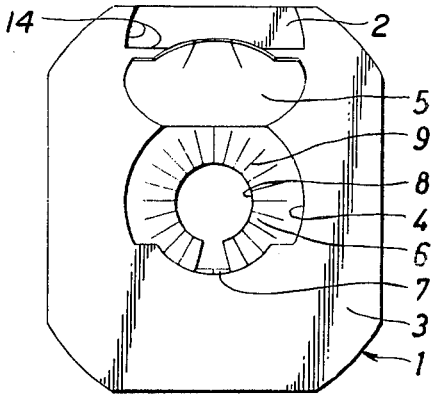
Figure 6:
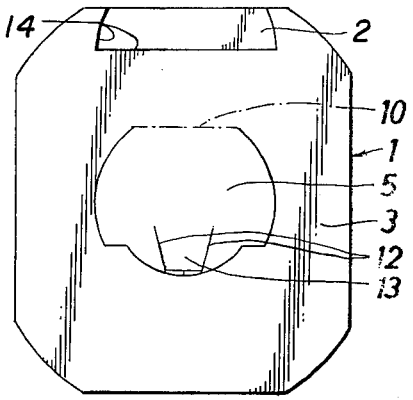
Figure 8:
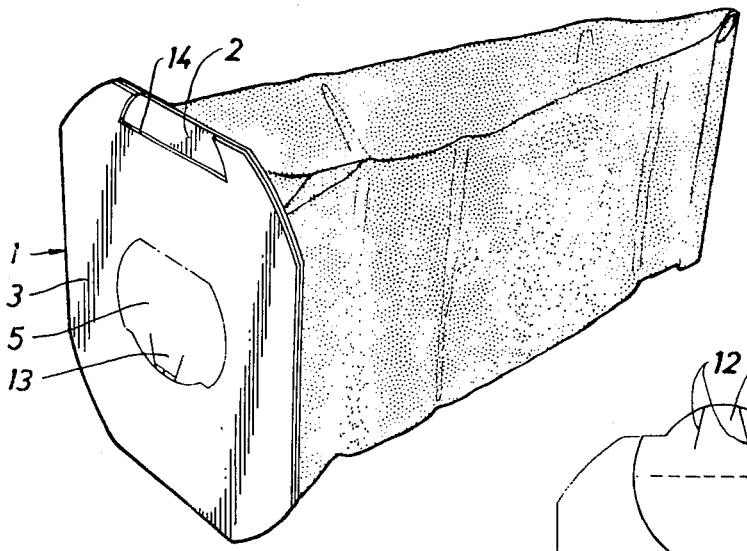
Figure 7:
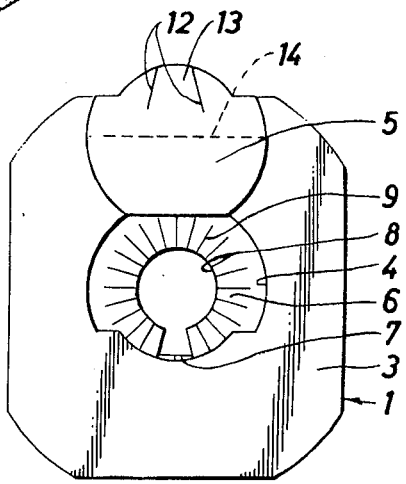

A few examples of embodiments of the object of the invention will be described with reference to the accompanying drawings, in which FIG. 1 is a view of the endwall of a dust collecting bag, according to a first example of an embodiment of the invention showing the uncovered opening FIG. 2 is a corresponding view of the dust collecting bag illustrated in FIG. 1 but showing the flap covering the opening FIG. 3 shows an inner sheet constituting part of the endwall, FIG. 4 shows an outer sheet constituting part of the same endwall before its mounting, FIG. 5 is a view corresponding to FIG. 1 illustrating a dust collecting bag according to a second example of an embodiment of the invention, FIG. 6 is a view corresponding to FIG. 2 illustrating the dust collecting bag of the embodiment shown in FIG. 5, FIG. 7 is a corresponding view of the last mentioned dust collecting bag with the flap engaged in an open position, and FIG. 8 is a perspective view of a dust collecting bag of the invention.

The dust collecting bag according to FIG. 8, is made of a filter material, as is well known. The part of the bag made of filter material is fastened to the back side of the endwall indicated at 1, e.g., by glueing. In one embodiment according to FIGS. 1–4, the endwall 1 comprises two sheets 2 and 3, connected with each other e.g., by glueing. The end wall also can be made in the shape of a large sheet of stiff material, e.g., paper board, which is bent double. Sheet 3 of the endwall 1 exhibits a central opening 4, which can be covered and uncovered respectively by pivoting of a cover flap 5 hinged on the sheet 3 along a portion of the edge of said opening. The flap which may be an integral part of the endwall is shaped such that at least a part of its free defining edge is positioned within the area of the opening when it covers the opening of the sheet 3. In the embodiment illustrated in the drawing, the whole free defining edge of the cover flap is positioned within the area of the opening of the sheet 3. Sheet 2 of the endwall includes a number of flaps of a resilient material defining an opening 8 therein and bridging the interspace between the edges of the cover flap and the opening in sheet 3 when sheets 2 and 3 are connected; these flaps are indicated at 6 and 7. The flaps 7 which are somewhat shorter than the flaps indicated at 6, keep the cover flaps in its position shown in FIG. 2, where the flaps 7 lie against the outside of the cover flap. As is most clearly evident from FIG. 3, the locking flaps 6 and 7, in the embodiment illustrated, are arranged along the edge of the opening 8 and are shaped by slits 9 cut in a radial direction from the edge of the opening. Right in front of the short locking flaps 7, the cover flap 5, which is punched out of the outer sheet 3 and constitutes an integral part therewith connected along the folding line indicated at 10, exhibits an edge 11, which is substantially parallel to the end edges of the locking flaps 7. The locking flaps 6 extend farther past the edge of the covering flap 5 than the locking flaps 7 do, which means that the locking flaps 7 are passed by the cover flap 5 during its pivoting movement to the closing position, while the cover flap still lies against the outside of the locking flaps 6. Upon closing the cover flap, the locking flaps 7 thus are positioned at the outside of the cover flap and retain the same in closed position.

The endwall illustrated in FIGS. 5 – 7 has been given the same reference numbers for those details which correspondingly appear in the embodiment illustrated in FIGS. 1 – 4. The dust collecting bag according to the second embodiment differs from the one described above substantially with respect to the cover flap 5, which at its free edge portion opposite the hinged mounting exhibits two slits 12, and the locking flaps 7 which are shorter than the locking flaps in the previous Figures. In connection with the closing operation, the edge portion of the cover flap positioned between the slits is bent out of the plane of the other portion of the cover flap past the locking flaps 7. Behind the pivotable mounting of the cover flap, the endwall, in addition, exhibits a cut out portion 14, the defining edge of which occupies such a position that the free edge of the cover flap can be flipped past the same, which makes possible a steady support of the cover flap in an open position, when the dust collecting bag is used.

In connection with vacuum cleaners provided with a lid exhibiting a tube penetrating into the dust collecting bag, the locking flaps 6 and 7 cooperate to provide a comparatively efficient tightening and stiffening up against said tube providing a good adaptability to different tube dimensions.

The invention is not limited to the embodiments described above and illustrated in the drawings by way of example only, but can be varied as to its details within the scope of the following claims.

I claim:

1. Dust collecting bag including a substantially rigid endwall, said endwall comprising:

a central opening, said opening including locking means disposed about a small portion of its edge;

a cover flap having a free defining edge, said cover flap pivotally resiliently mounted on said endwall along a portion of the edge of said opening, said cover flap covering said opening when locked into a covering position by said locking means, with at least a portion of said free defining edge positioned within the area of the opening;

said cover flap further includes the presence of slits extending from said at least a portion of said free defining edge, said portion located substantially diametrically opposite the pivotable mounting of said cover flap and with the part of said free edge defined by said slits being pivotable out of the plane defined by the remainder of the cover flap;

said locking means located substantially diametrically opposite the pivotal mounting of said cover flap and consisting of at least one pliable locking flap, said locking flap overlying said at least a portion of said free defining edge and biased against the resilient mounting of the cover flap when the cover flap is in a closed and locked position.

* * * * *